US005702507A

United States Patent [19]

Wang

[11] Patent Number: 5,702,507

[45] Date of Patent: Dec. 30, 1997

[54] AUTOMATIC AIR CLEANER

[75] Inventor: Shou-Ting Wang, Taipei Hsien, Taiwan

[73] Assignee: Yih Change Enterprise Co., Ltd., Taipei Hsien, Taiwan

[21] Appl. No.: 714,999

[22] Filed: Sep. 17, 1996

[51] Int. Cl.[6] ..... B03C 3/155

[52] U.S. Cl. ..... 96/55; 55/279; 96/63; 96/74; 96/97; 422/124; 422/186.1

[58] Field of Search ..... 96/55, 63, 66, 96/68, 69, 74, 84, 97; 95/58, 63, 70, 78; 55/279; 422/4, 5, 22, 28, 120, 122–124, 186.04, 186.07, 186.1; 361/226, 233

[56] References Cited

U.S. PATENT DOCUMENTS

| | | | |
|---|---|---|---|
| 4,477,263 | 10/1984 | Shaver et al. | 96/97 X |
| 5,055,115 | 10/1991 | Yikai et al. | 96/97 X |
| 5,322,550 | 6/1994 | Park | 96/66 |
| 5,407,469 | 4/1995 | Sun | 361/226 X |
| 5,456,741 | 10/1995 | Takahara et al. | 96/97 X |
| 5,484,472 | 1/1996 | Weinberg | 96/55 X |
| 5,492,557 | 2/1996 | Vanella | 55/279 X |
| 5,578,113 | 11/1996 | Glenn | 96/97 X |
| 5,614,002 | 3/1997 | Chen | 96/69 X |
| 5,622,543 | 4/1997 | Yang | 96/97 X |

*Primary Examiner*—Richard L. Chiesa
*Attorney, Agent, or Firm*—Bacon & Thomas

[57] ABSTRACT

An automatic air cleaner has a case and a base; wherein the case has a central cavity provided with a number of receiving grooves defined by ribs disposed at both inner lateral walls of the central cavity for a dust collecting plate and a filter plate to be inserted therein. Dirty air pumped into the case body is cleaned in sequence, moving from the dust collecting plate having rectangular dust collecting members cooperating with electric discharge rods, the filter plate made up of non-woven fabric and provided with an odoriferous agent, and then an ozone tube whose generation of ozone contributes to the termination of bacteria existing in the air. Finally anion pins are adapted to electrify the dust left over in the air so that when the fresh air blown out of the through slots of the case by fans driven by motors, the dust will drop onto the ground. In addition, the dust collecting plate, filter plate, and ozone tube can be easily replaced or withdrawn for cleaning in maintenance.

2 Claims, 3 Drawing Sheets

AUTOMATIC AIR CLEANER

BACKGROUND OF THE INVENTION

The present invention relates to an automatic air cleaner, especially to an air cleaner having a case provided with a central cavity wherein a number of engaging grooves defined by ribs are disposed at the inner lateral walls of the central cavity for a dust collecting plate and a filter plate to be inserted therein or withdrawn therefrom. In addition, an ozone tube is disposed behind the filter plate so as to purify further the air passing through the former two layers, and two fans driven by motors are adapted to pump out the fresh air finally cleaned by anion pins disposed at the rear of the case.

A conventional air cleaner is mainly comprised of a cross-like electric polar plate and electric discharge rods in correspondance to the polar plate so as to discharge electricity and collect dusts onto the cross-like electric polar plate. Yet, the electric discharge rods are easily eroded and blunted out of use, unable to discharge electricity any more and making the air cleaner function abnormally. Furthermore, the conventional air cleaner can only partially clean the dirty air with bacteria and dust still left in the air discharged again out of the air cleaner thereof. Besides, the cross-like electric polar plate and the electric discharge rods are fixedly assembled inside a case body, unable to be replaced or withdrawn for cleaning.

SUMMARY OF THE PRESENT INVENTION

It is therefore the primary object of the present invention to provide an automatic air cleaner having a dust collecting plate, a filter plate provided with odoriferous agent, and an ozone tube which can be easily and conveniently replaced or withdrawn for cleaning.

It is a further object of the present invention to provide an automatic air cleaner permitting air flowing therethrough to be cleaned in a multiple form so as to purify completely the air passing therethrough.

It is a third object of the present invention to provide an automatic air cleaner which is easily operated and has a prolonged lifespan.

DETAILED DESCRIPTION OF THE PREFERRED EMBODIMENTS

Figure 1:
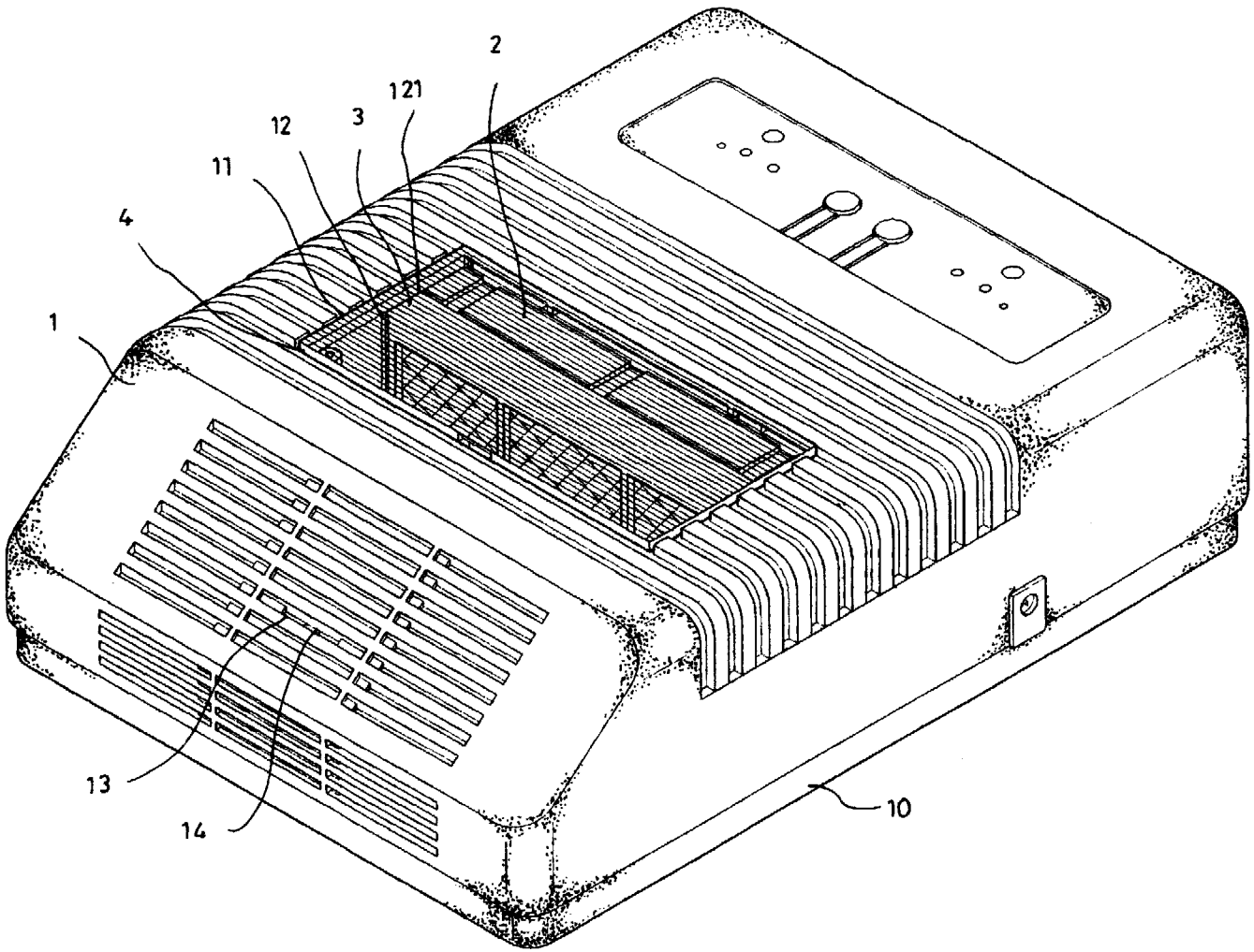
FIG. 1 is a perspective view of the present invention.
Figure 2:
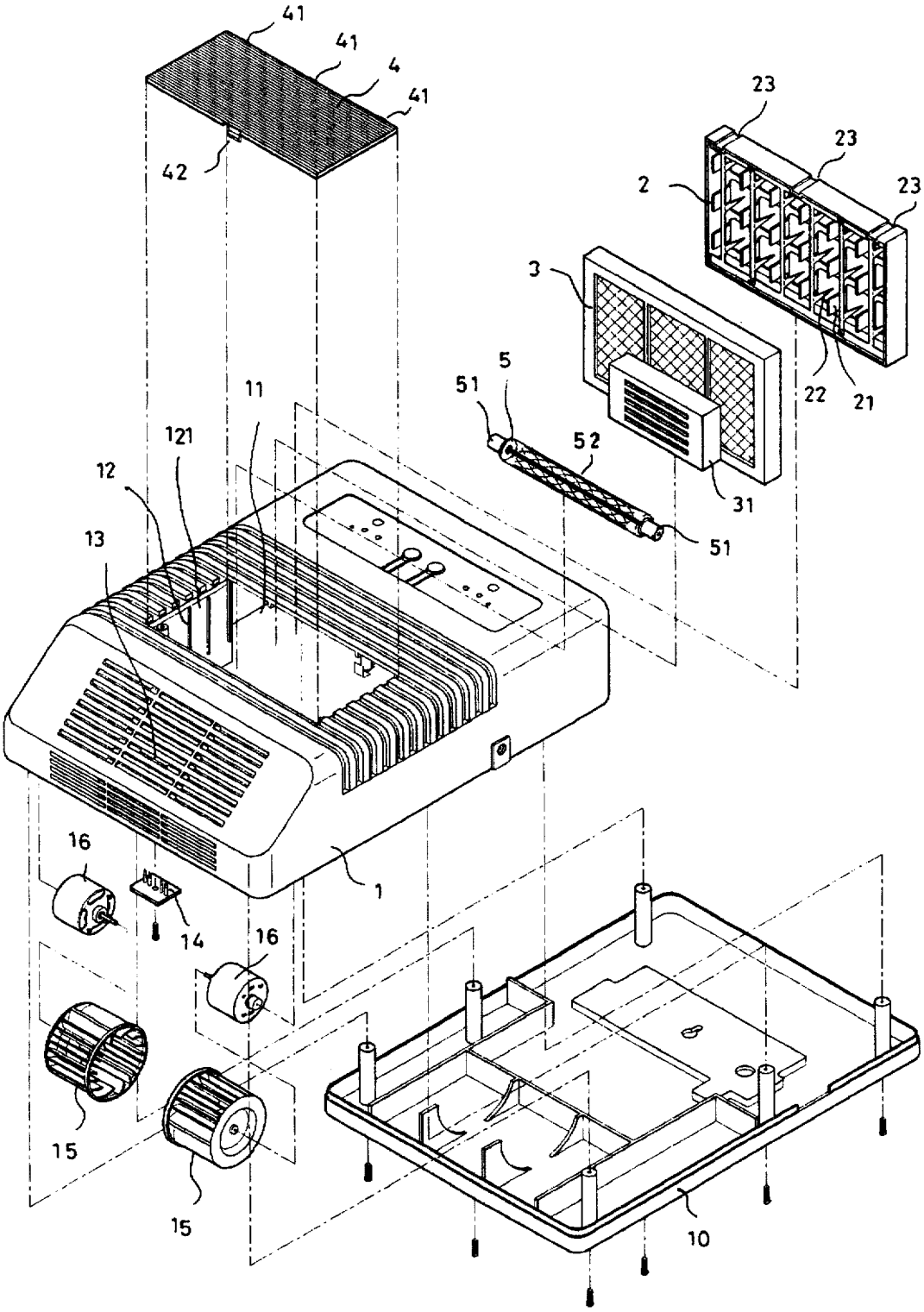
FIG. 2 is a perspective exploded view of the present invention.

Please refer to FIGS. 1 and 2. The present invention relates to an automatic air cleaner including a case 1 having a base 10; wherein the case 1 is provided with a central cavity 11 having a number of ribs 12 disposed at both inner lateral walls of the central cavity 11 thereof. Between every two of the ribs 12 is disposed a receiving groove 121 for the insertion of either a dust collecting plate 2 or a filter plate 3. The dust collecting plate 2 is equipped with a plurality of rectangular, parallel and juxtaposed collecting means 21 and needle-like electric discharge rods 22 extending alternately between the rectangular dust collecting means 21 in opposite direction. When supplied with electricity at a proper place, the dust collecting means 21 and the electric discharge rods 22 will cooperate, causing the air to be electrically charged so as to collect such air onto the dust collecting plate 2. The filter plate 3 located behind the dust collecting plate 2 and inserted into the receiving groove 121 of the case 1 in the same way as the dust collecting plate 2 is made of non-woven fabric, having deodorant active carbon thereon to filter further the dust particles escaped from the dust collecting plate 2.

In addition, to provide a fragrant smell, an odoriferous agent 31 is attached to the filter plate 3 at the lower front thereof. An ozone tube 5 is disposed behind the filter plate 3, with the poles 51 of the ozone tube 5 retained by pole holders 53 disposed at the left and right sides of the central cavity 11 of the case 1. The ozone tube 5 permeated with inert gas inside and covered with conductive electric wire 52 outside, contacts with electrodes 54 for generation of ozone so as to restrain the propagation of bacteria. Besides, the ozone tube 5, replaced by withdrawing like a light tube, is very stable in use—free from oxidation and prolonged in operation lifespan.

A plurality of through slots 13 are provided at the rear of the case 1 for clean air to pass therethrough. And two fans 15, each driven by a motor 16, is disposed at both lateral sides inside the rear of the case 1 so as to blow the clean air out of the through slots 13. Furthermore, anion pins 14 are disposed at the middle section inside the rear of the case 1 to electrify and screen finally the unfiltered dust in the air, permitting the fresh and clean air to be discharged out of the through slots 13. A liftable cover 4 is disposed in closing match with the central cavity 11 of the case 1. A number of engaging grooves 23 are disposed upon the top surface of the dust collecting plate 2, corresponding to a number of stop blocks 41 disposed at the front side of the cover member 4, and an insert clasp 42 is disposed at the rear side of the cover member 4 to be engaged within the inner flange at one side of the central cavity 11 of the case 1 so as to engage the liftable cover 4 with the central cavity 11 thereof.

Figure 3:
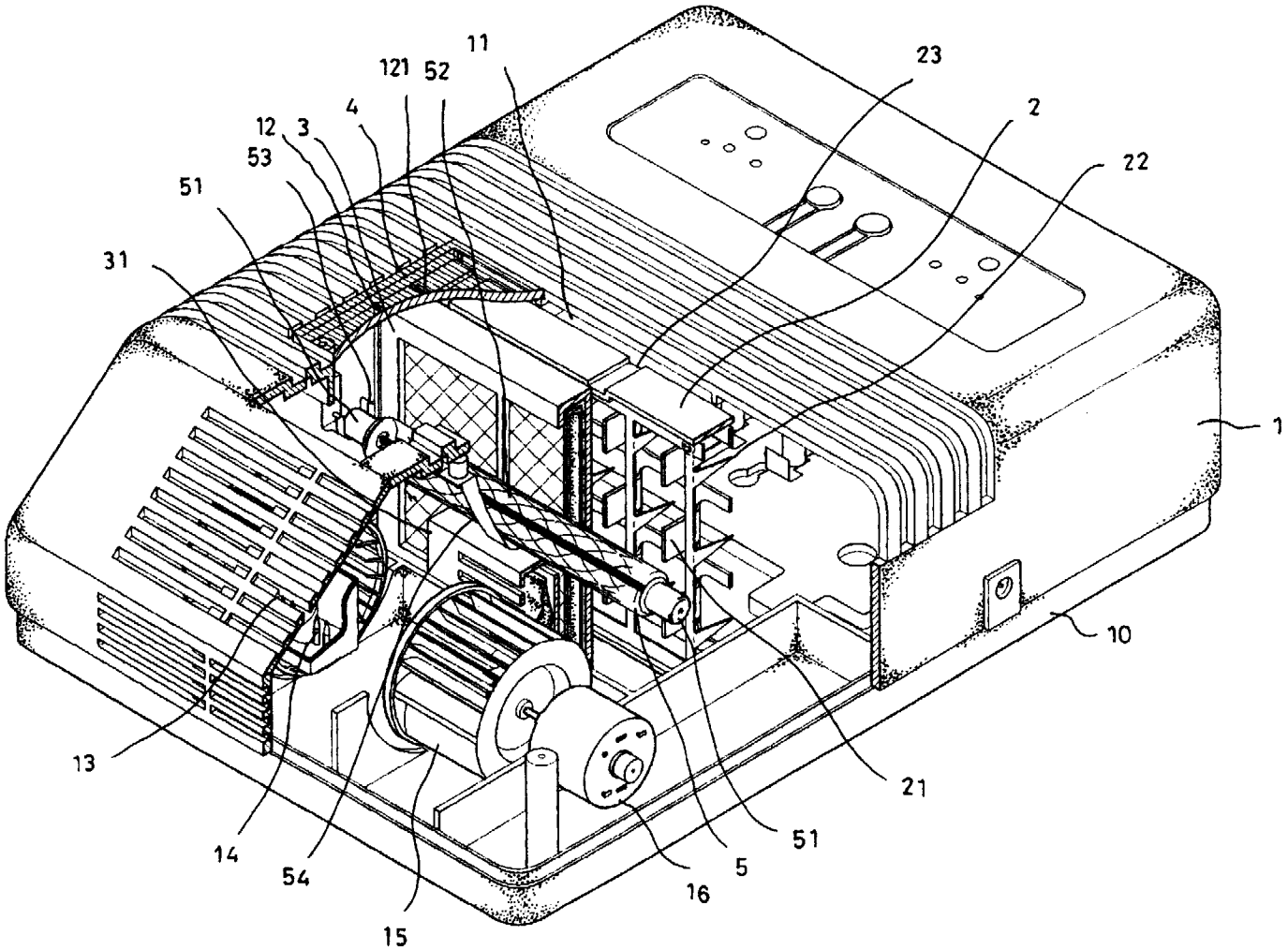
FIG. 3 is a sectional view of the present invention.

Please refer to FIG. 3. In practical use, the automatic air cleaner of the present invention is placed either in a vehicle or indoors. When the power is switched on, dirty air is drawn into the case 1 from the front by the fans 15 driven by the motors 16 placed at the rear of the case 1. The air drawn therein is made to pass the dust collecting plate 2, electrified by the electric discharge rods 22 thereof and leaving the dust of the air electrically charged attached onto the dust collecting means 21. The air passing through the dust collecting plate 2 then moves onto the filter plate 3, cleaned further by the filter plate 3 having deodorant active carbon disposed thereon and purfumed by the odoriferous agent 31 disposed at the lower section thereof. The non-woven fabric of the filter plate 3 will screen the second time the dirt particles left in the air and the odoriferous agent 31 of the filter plate 3 will make the air leaving the filter plate 3 with a fragrant smell. The ozone tube 5 disposed behind the filter plate 3 is then adapted to purify further the air, whose poles 51 and conductive electric wire 52 contacted with the electrodes 54 contribute to the generation of ozone that would terminate the bacteria existing in the air. Before the cleaned air is discharged out of the case 1 via the through slots 13, the air is in the last step cleaned by the anion pins 14 which would electrify the dust remained in the air, making the dust uncleaned to drop onto the floor when the fresh air is blown out of the case 1 by the fans 15 driven by the motors 16.

In addition, to clean or maintain the present invention is quite easy and simple. After the liftable cover 4 is removed from the central cavity 11 of the case 1, the dust collecting plate 2 and filter plate 3 can be withdrawn from the engaging grooves 121 defined by the ribs 12 of the central cavity 11, while the ozone tube 5 can be drawn directly from the electrodes 54 and the poles 51 drawn from the pole holders 53 disposed at the left and right lateral walls of the central cavity 11 thereof.

What is claimed is:

1. An automatic air cleaner comprising a case having a central cavity disposed at the center and through slots at the rear and a base, wherein a liftable cover having stop blocks and an insert clasp disposed at the front and rear thereof respectively is provided to close the central cavity of said case; said case is characterised by that;

a plurality of ribs are diposed at both inner lateral walls of said central cavity, defining a number of receiving grooves therebetween for a dust collecting plate and a filter plate to be inserted therein; said dust collecting plate has a plurality of rectangular parallel dust collecting means juxtaposed thereon and a plurality of electric discharge rods extending alternatively between said dust collecting means in opposite direction; dirty air passing through the dust collecting means is then further cleaned by the filter plate provided with deodorant active carbon thereon and perfumed by an odoriferous agent disposed at the lower front of said filter plate; an ozone tube, covered with conductive electric wire outside and retained by pole holders behind the filter plate for easy replacing and withdrawing, functions with electrodes to generate ozone so as to terminate the bacteria existing in the air passing out of the filter plate; finally anion pins adapted to electrify the dust left over in the cleaned air so that when the fresh air delivered out of the through slots by fans driven by motors disposed at both lateral sides of the rear of the case, the dust electrified will drop onto the floor.

2. An automatic air cleaner according to claim 1, wherein the filter plate is made up of non-woven fabric.

* * * * *